US010233654B2

(12) United States Patent
Choi

(10) Patent No.: US 10,233,654 B2
(45) Date of Patent: Mar. 19, 2019

(54) FLOORING CONSTRUCTION AND METHOD

(71) Applicant: Hanssem Co., Ltd., Kyung-ki (KR)

(72) Inventor: Jin-ho Choi, Gyeonhggi-do (KR)

(73) Assignee: Hanssem Co., Ltd., Kyungki-do (KR)

( * ) Notice: Subject to any disclaimer, the term of this patent is extended or adjusted under 35 U.S.C. 154(b) by 0 days.

(21) Appl. No.: 15/755,756

(22) PCT Filed: Feb. 2, 2017

(86) PCT No.: PCT/KR2017/001126
§ 371 (c)(1),
(2) Date: Feb. 27, 2018

(87) PCT Pub. No.: WO2017/146390
PCT Pub. Date: Aug. 31, 2017

(65) Prior Publication Data

US 2019/0024386 A1 Jan. 24, 2019

(30) Foreign Application Priority Data

Feb. 22, 2016 (KR) ..... 10-2016-0020606
Nov. 9, 2016 (KR) ..... 10-2016-0148524

(51) Int. Cl.
*E04F 15/10* (2006.01)
*E04F 15/02* (2006.01)
(Continued)

(52) U.S. Cl.
CPC .. *E04F 15/02038* (2013.01); *E04F 15/02022* (2013.01); *E04F 15/02033* (2013.01);
(Continued)

(58) Field of Classification Search
CPC ..... E04F 15/02038; E04F 15/02022; E04F 15/02033; E04F 15/041; E04F 15/107; E04F 19/04
See application file for complete search history.

(56) References Cited

U.S. PATENT DOCUMENTS 792,979 A * 6/1905 Fulghum ..... E04F 15/04 403/331
4,452,604 A * 6/1984 Lenox ..... B41M 1/30 8/470
(Continued)

FOREIGN PATENT DOCUMENTS

JP 10 266532 A 10/1998
JP 3068323 U 5/2000
(Continued)

*Primary Examiner* — Paola Agudelo
(74) *Attorney, Agent, or Firm* — Howson & Howson LLP

(57) ABSTRACT

This invention relates to an assembly type floor panel that is easy to assemble, dismantle, and maintain, and that closely and nonadhesively contacts an underlying floor. The floor panel is composed of a base panel of elastic material, e.g., calcium carbonate, a stiffer panel on the upper side of the base panel and a sliding protective sheet on the bottom side of the base panel. Adjacent panels are joined by the cooperation of a projection and groove along an edge of one panel with a projection and groove along an edge of an adjacent panel. By virtue of the elasticity of the base panel and the protective sheet, the floor panel can closely contact an underlying floor, accommodate uneveness in the underlying floor, and conduct heat from the underlying floor.

6 Claims, 7 Drawing Sheets

(51) Int. Cl.
*E04F 15/04* (2006.01)
*E04F 19/04* (2006.01)

(52) U.S. Cl.
CPC ..... *E04F 15/041* (2013.01); *E04F 15/107* (2013.01); *E04F 19/04* (2013.01)

(56) References Cited

U.S. PATENT DOCUMENTS 4,818,590 A * 4/1989 Prince ..... A47B 96/206 428/213
5,344,700 A * 9/1994 McGath ..... E04B 1/12 428/304.4
5,548,937 A * 8/1996 Shimonohara ..... F16B 5/0076 52/259
6,103,333 A * 8/2000 Keith ..... B32B 21/08 428/99
7,951,441 B2 * 5/2011 Wu ..... E04F 15/02 428/213
2002/0050114 A1 * 5/2002 Friso ..... E04F 15/04 52/782.1
2005/0208255 A1 * 9/2005 Pervan ..... B32B 21/02 428/60
2014/0093677 A1 * 4/2014 Permesang ..... E04F 15/02038 428/99
2016/0069086 A1 * 3/2016 Hullenkremer ... E04F 15/02011 52/588.1
2016/0153199 A1 * 6/2016 Curry ..... E04D 11/00 52/588.1
2016/0273230 A1 * 9/2016 Yang ..... E04F 15/02038

FOREIGN PATENT DOCUMENTS

JP 2003 49530 A 2/2003
KR 2002 0066607 A 8/2002

* cited by examiner

FLOORING CONSTRUCTION AND METHOD

FIELD OF THE INVENTION

This invention relates to an assembly type floorboard that closely contacts an underlying supporting surface non-adhesively, and to a construction method utilizing the floorboard, in which construction, dismantling and maintenance are carried out easily. More specifically, the floorboard is composed of a base panel made of an elastic material, and other material stiffer than the base panel including a surface material stacked on the upper side of the base panel, and a sliding protective sheet stacked at the bottom side of the base panel. The new floorboard closely and firmly contacts the underlying floor, and facilitates construction and dismantling by having a projecting part and a binding groove on both sides of the base panel. The projecting part and binding groove on one side of the base panel can cooperate with a binding groove and projecting part on an adjacent base panel.

BACKGROUND OF THE INVENTION

In general, an assembly type flooring panel for indoor installation is a rectangular panel having a projecting part, i.e., a "tongue," formed along one edge and a groove formed along an opposite edge. A floor is assembled by arranging a plurality of such panels in side-by-side relationship with a projecting part of each panel except for an end panel, fitting into a groove of an adjacent panel. As depicted in FIG. 8, the mainly used methods are adhesive construction, carried out by fixing the panels to an underlying floor with adhesive, suspension construction carried out by laying the floor panels on an underlying floor covered with a moisture-resistant protective sheet, and a junction type construction carried out by erecting a structure that causes the floor panels to float above the underlying floor of a room in an office or sports center by a fixed amount.

In the adhesive type construction method, the floor panel is fixed to the underlying layer, typically a mortar layer, with adhesive. The heat conduction rate for such a floor construction is good in the case of a heating system in which heat is applied to the underside of the underlying floor, for example, the Korean "ondol" floor heating system. Moreover, because the floor is inflexible it does not bend when walked upon, and the feel of the floor is good. This type of floor is also resistant to deformation after construction owing to its stabilized size, and has the advantage of blocking cement dust because the floor panels are glued in place. However, dismantling the floor is difficult and requires skilled professionals. Changing the size of the floor requires additional construction adhesive.

In the case of the adhesive type construction method, construction and dismantling are difficult because the assembly type floor panel is fixed on the floor by adhesion. The adhesive type construction method also has the problem that, when floor panels made of wooden material are used, their contraction and expansion makes assembly difficult.

The suspension type construction method, which is carried out by assembling the floor panel using adhesive or another type of binding on the panel after laying a film on the floor for blocking moisture and laying a cushion. The suspension type method allows for deformation in size, and the floor is easy to dismantle. Adhesive is either not used, or its use is minimized during construction. Thermal conduction is not as good as in the case of the adhesive type construction, due to the floating structure, dust can accumulate because of the gap between the panels and the underlying floor, and the structure is relatively vulnerable to moisture, and characterized by an undesirable feel when walked upon due to its flexible bending.

The junction type construction method is utilized mainly for heavy walking owing to its high strength and elasticity, and is therefore suitable for use in sports facilities, auditoriums and stages. It is characterized by various the features in its lower structure such as the electric circuits and various methods of nailing and adhesion. It has problems of less heat effectiveness in floor heating due to its lower heat conduction rate due to its floating structure, dust in the gap between the floor panels and the underlying floor, higher construction cost due to the high price of construction materials, and echoing sounds at locations where the floor panels are not in contact with supporting structure.

Accordingly, there is a need for an assembly type floor panel and a close contacting construction method which minimize the creation of harmful dusts such as dust scattered during floor construction, which avoid the use of PE foam, which is environment friendly and easy to dismantle due to the avoidance of adhesive, and which does not bend or move horizontally when in contact with the underlying floor.

SUMMARY OF THE INVENTION

An object of this invention is to solve the above problems. More specifically, the floor panel in accordance with the invention is composed of a base panel of elastic material, a surface material, stiffer than the base panel and stacked on the upper side of the base panel, and a sliding protective sheet stacked at the bottom side of the base panel. The purpose of this structure is to provide a new panel which is capable of close and firm contact with an underlying floor, which can be easily assembled and dismantled as a result of the cooperation of a projecting part and a binding groove on both sides of the base panel, with binding grooves and projecting parts, respectively, on adjacent base panels. The invention provides an assembly type floor panel that non-adhesively and closely contacts an underlying floor, and a construction method in which construction, dismantling and maintenance are carried out easily.

The floor panel in accordance with the invention is composed of a base panel 10, made of elastic material, and a surface layer composed of material stiffer than the base panel 10. The surface material 20 is stacked on the upper side of the base panel 10 and a sliding protective sheet 30 is layered at the bottom side of the base panel 10. A binding groove 12 and a projecting part 11 are provided on both sides of the base panel 10.

One preferred material for the base panel 10 is calcium carbonate board. Another preferred material for the base panel 10 is foamed PVC board.

The sliding protective sheet 30 is preferably a non-woven fabric 31 having a silicone coating on its bottom side.

According to another aspect of the invention, the projecting part 11 and the binding groove 12 are provided with a coating 40 of silicone or rubber.

According to still another aspect of the invention, the projecting part 11 is in the shape of a tubular rod 50, in which a liquid adhesive 51 of low viscosity is stored internally. A metal colliding member 60 is provided at the upper side of the tubular rod 50, and the tubular rod 50 is made of a highly brittle synthetic resin. If, when the projecting part in the form of a tubular rod containing low viscosity liquid adhesive 0base panel is engaged with a binding groove of an adjacent panel, the upper side of the assembly type floor panel joint is struck downwardly, the brittle tubular rod 50 is damaged by the impact of the colliding member 60, and the adhesive 51 stored in the tubular rod 50 is discharged to the exterior of the tubular rod.

According to still another aspect of the invention, the closely contacting construction method for the above floor panel is includes a mortar floor cleaning stage S100 which minimizes the horizontal tolerance by cleaning the dust and foreign matter from the mortar floor where the assembly type floor panel is to be constructed, a sliding protective sheet installing stage S200, in which a sliding protective sheet is brought into contact with the cleaned mortar floor without the use of adhesive, an assembly type floor panel cutting stage S300, in which the edge of the floor panel is cut according to the dimension of the floor without creating dust and noise, and an adjacent floor panel combining stage S400 for finalizing the floor construction by assembling adjacent floor panels while placing them on the sliding protective sheet.

According to another feature of the present invention, the assembly type floor panel is such that it does not slip downward when it is put on a cement board inclined at an angle of 60 degrees relative to the horizontal, and such that it takes less than 20 minutes for its surface temperature to increase by 10° C. from 25° C. in a constant temperature, 45° C. water bath.

The invention may be modified in a variety of ways and is not intended to be limited to the embodiments shown as examples in the drawings and explained specifically in this specification. In addition, terminology used only for explaining a certain embodiment is not intended to limit the invention. Singular expressions are intended to include plural expression unless the context clearly indicates otherwise. The terms "include" and "have" as used herein to designate the existence of a feature, figure, state, motion, constituent factor, part or combination of these thereof, should not be understood to exclude the existence or the additional possibility of one or more other features, figures, states, motions, constituent factors, parts or combinations thereof.

The assembly type floor panel in accordance with the invention contacts the underlying floor closely but non-adhesively, and facilitates construction, dismantling and maintenance. When the floor panels are brought into contact with the sliding protective sheet and the projecting parts are engaged with the binding grooves, the base panels form a level floor even when the underlying floor is not in perfect plane as the base panels are made of elastic board and the entire sliding protective panel contacts the floor without floating above from the floor. The assembly type floor panel can be fixed closely to the underlying floor without using adhesive, heat is conducted from the underlying floor to the upper side effectively during heating and bending due to unevenness of the floor plane is avoided.

DETAILED DESCRIPTION

Figure 1:
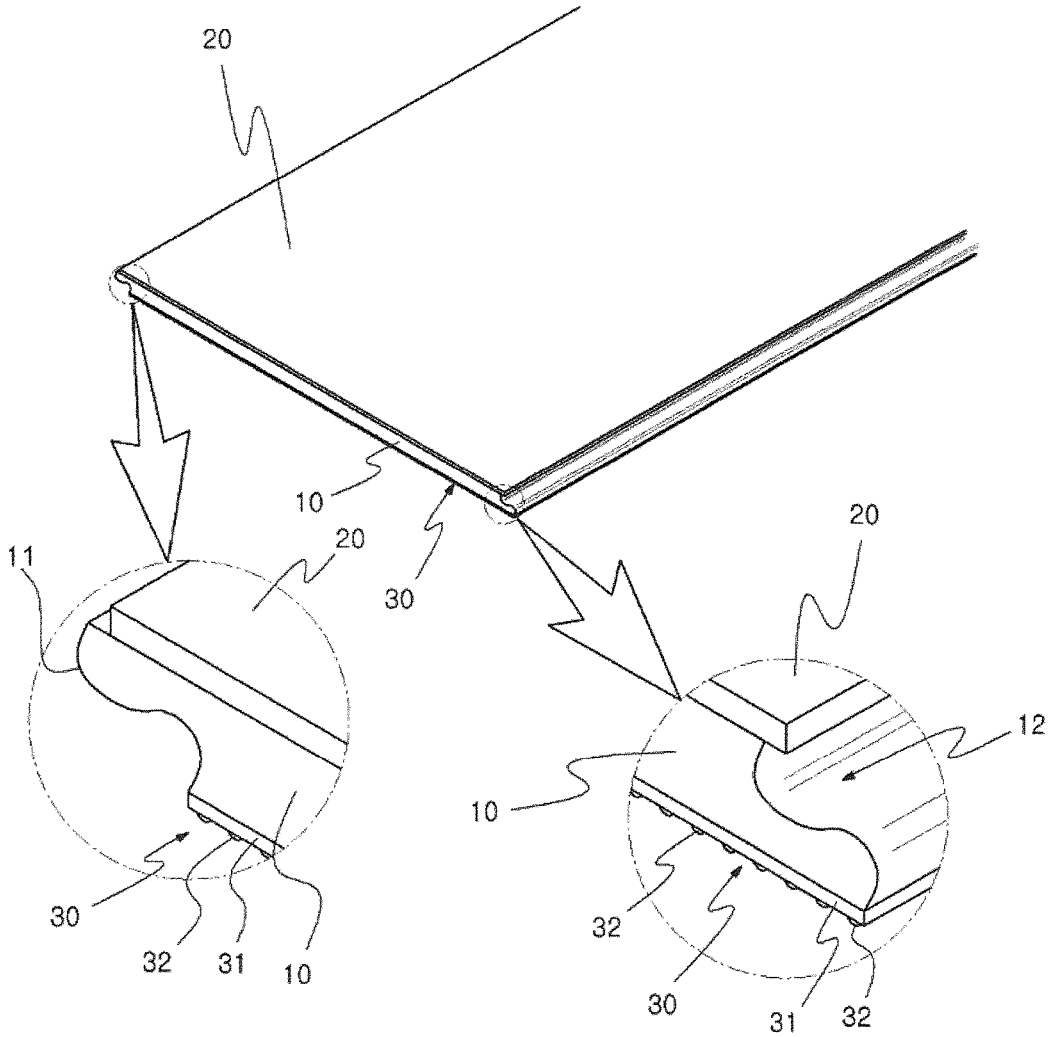
FIG. 1 is a perspective view of an assembly type floor according to the invention.
Figure 2:
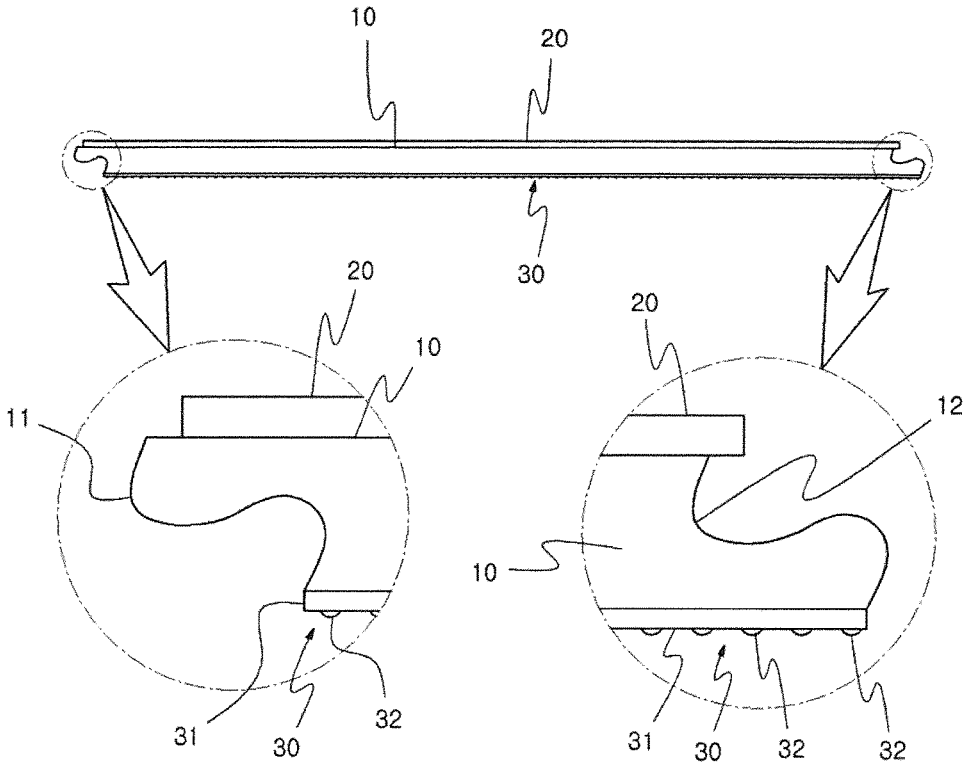
FIG. 2 is an elevational view of the assembly type floor panel of FIG. 1.
Figure 3:
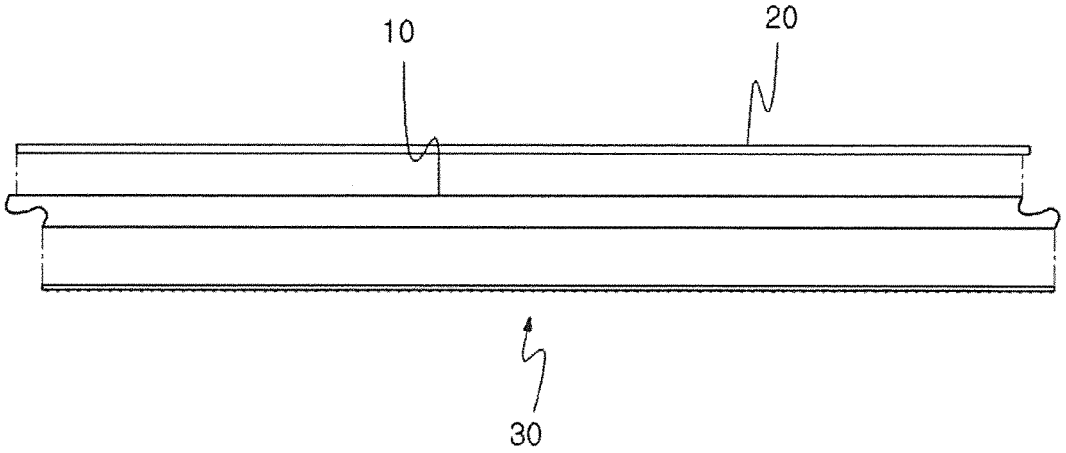
FIG. 3 is an exploded side elevational view which depicts the assembly type floor panel in a disassembled state.

In the preferred embodiment of the invention, the assembly type floor panel is in close, non-adhesive, contact with an underlying floor. The floor panel of the invention makes construction, dismantling and maintenance easy by being composed of an elastic base panel 10 and a material stiffer than the base panel 10, and includes a sliding protective sheet 30 layered on the bottom side of the base panel 10, and binding grooves and projecting parts are provided on both sides of the base panel and configured to cooperate with binding grooves and projecting parts on adjacent panels.

FIGS. 1-4 depict a floor panel according to the invention, which comprises a base panel 10 of elastic material, a layer of surface material 20 on the upper side of the base panel 10 and the sliding protective sheet 30 layered at the bottom side of the base panel 10.

More specifically, the base panel 10 is a calcium carbonate board with proper elasticity and flexibility. The calcium carbonate board is well known and used for the interior and exterior of buildings. The material is generally referred to as CC board. A projecting part 11 is formed along one side of the base panel 10, and a binding groove 12, which matches the projecting part 11, is formed along the other side. In the assembly of the floor, the projecting part 11 of one base panel 10 is inserted into the binding groove 12 of an adjacent base panel 10.

The surface material 20 is a material stiffer and of greater strength than the material of the base panel 10, such as vinyl, PVC, synthesized wood or natural wood. The surface material is in the form of a thin panel and is fixed adhesively to the top side of the base panel 10. In addition, it resists impact owing to its tile shape and its PVC composition, and it makes walking more comfortable as it is made of slightly elastic material.

The thickness of the surface material 20 is preferably 1.3 mm. If the thickness of the surface material is less than 1.3 mm, there is a risk that the weight of people walking on the flooring will cause damage due to the decreased strength of the surface material. If the thickness of the surface material exceeds 1.3 mm, it has disadvantage that walking becomes uncomfortable due to its deceased elasticity.

The sliding protective sheet 30 is made by coating the lower side of a layer 31 non-woven fabric with a silicone coating. The silicone coating 32 is in the form of dots spaced from one another on the non-woven fabric, and its functions include alleviating the transmission of noise between floors, allowing sliding of the panels relative to the underlying floor, improving the feel of the floor to individuals walking on it, and absorbing impact. The non-woven fabric 31 preferably has a thickness of 2.0 mm. If its thickness is less than 2.0 mm, its impact absorption is reduced. If the thickness of the non-woven fabric is greater than 2.0 mm, sliding protection becomes difficult as floating can begin due to dimensional errors.

Figure 4:
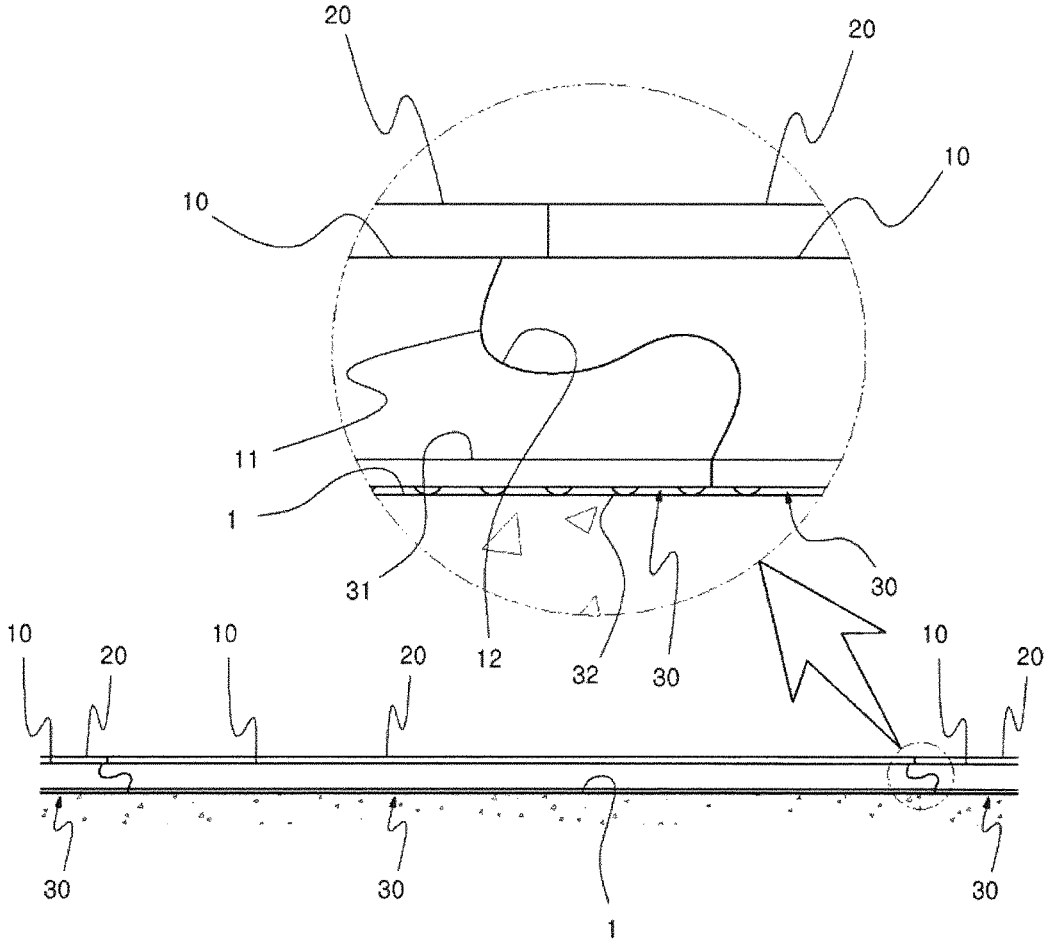
FIG. 4 is an elevational view which depicts the method of construction of the assembly type floor panel.

As shown in FIG. 4, the sliding protective sheet on the assembly type floor panel closely contacts the underlying floor 1 of a building, when the projecting part 11 is fitted to the binding groove 12 of an adjacent base panel 10 and put on the underlying floor 1.

The entire sliding protective panel of the base panel 10 contacts the underlying floor 1 perfectly without floating above the underlying floor, while the base panel 10 fits properly in spite of unevenness of the underlying floor, which may not be in a perfect plane, owing to the elastic calcium carbonate board of the base panel 10.

The base panel 10, made of flexible calcium carbonate board, is preferably 4.0-5.0 mm in thickness, with a density of 0.83 and a shrinkage rate less than 0.2% shrinkage rate. Due to its high water resistivity, the base panel is resistant to discoloration and dimensional changes when exposed to water during cleaning.

The assembly type floor panel in accordance with the invention can be fixed closely to the underlying floor without using adhesive. It is easy to install and dismantle, heat from the underlying floor 1 is conducted to the upper side of the floor effectively, and flexible bending due to unevenness of the underlying floor 1 is avoided. In addition, the assembly type floor panel has the advantage of avoiding dust and noise created by sawing, as it is possible to cut the panel with a knife, and there is no need to use a hammer in joining adjacent floor panels. Accordingly, construction of the floor can take place even at night as noise due to hammering is avoided. Furthermore, owing to the structure of the assembly type floor panel, construction quality is independent of the skillfulness of the workers, and the assembly type floor panel allows flexibility for easy construction.

In addition, the base panel 10 has the advantage that it can be made from various materials including natural wood that shrinks and expands with moisture, in addition to the synthetic resin used for the elastic surface material 20.

In this embodiment, carbonate calcium carbonate board was given as an example of the material of the base panel 10. However, as an alternative, foamed PVC board can be utilized as the material of the base panel.

In this case, it is desirable to reduce heat shrinkage, which is a disadvantage of PVC, by incorporating GF (Glass Fiber) into the PVC for improved dimensional stability.

Figure 5:
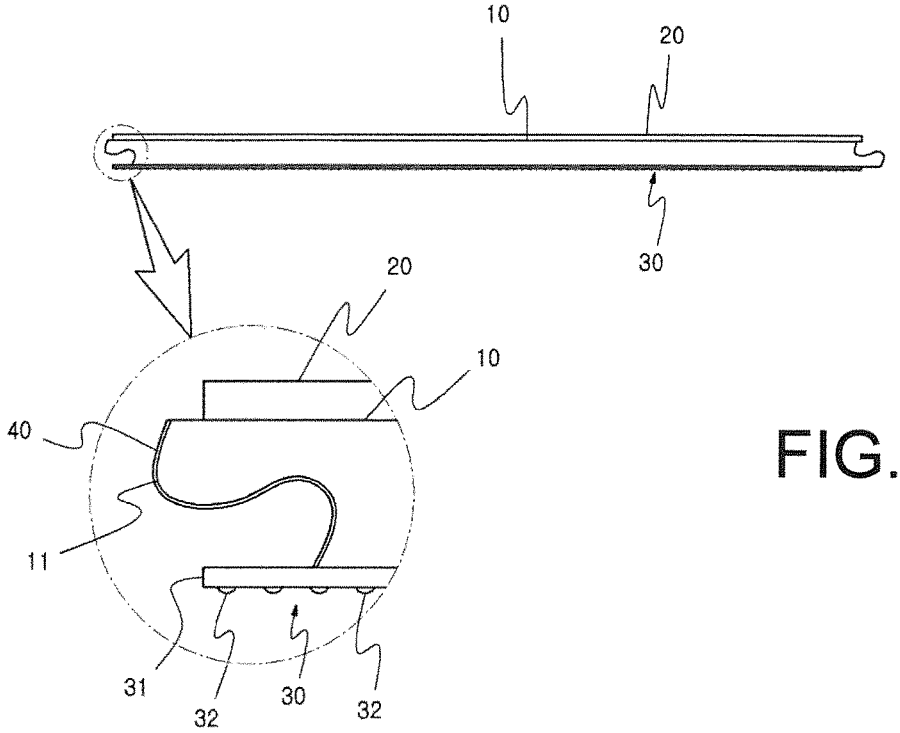
FIG. 5 is an elevation view which depicts a variation of the assembly type floor panel.

It is possible to coat the projecting part 11 with rubber 40 or silicone as depicted in FIG. 5. In this case, gaps between the adjoining floor panels are avoided when the projecting parts 11 are fitted into the binding grooves 12, and the anti-moisture feature of the assembly type floor panel is enhanced.

Figure 6:
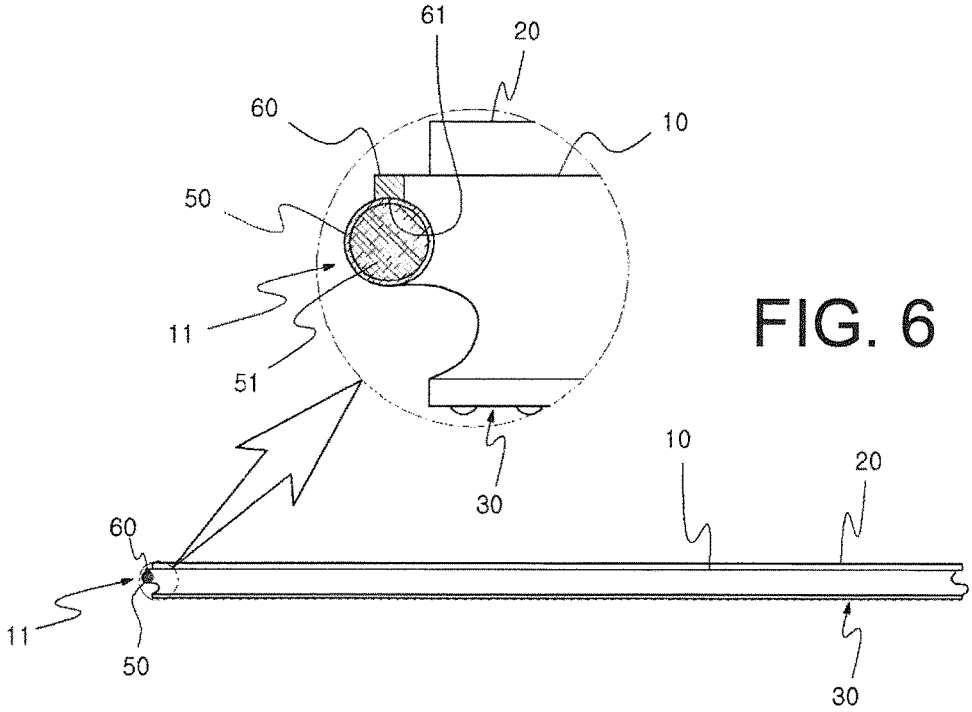
FIG. 6 is an elevational view, partly in cross section, which depicts another embodiment of the assembly type floor panel.
Figure 7:
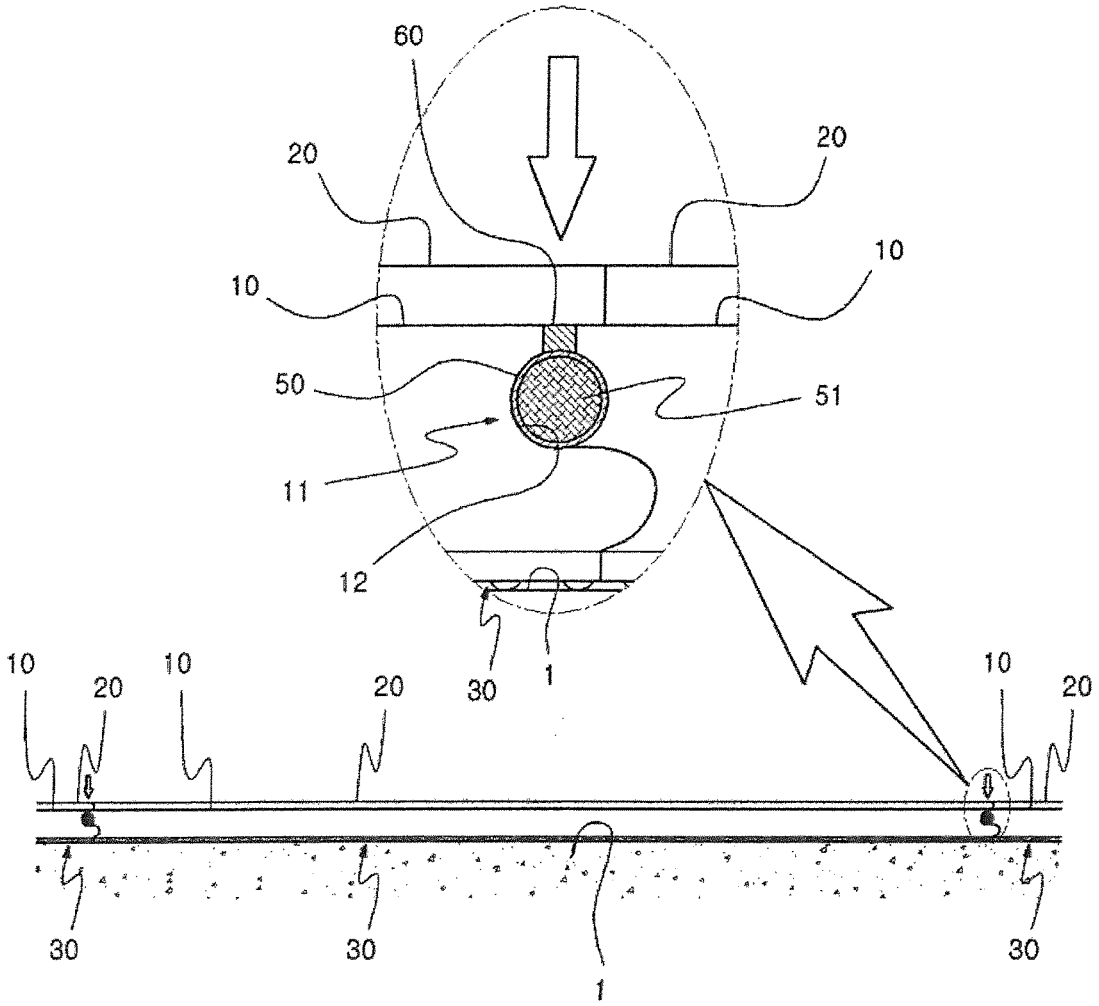
FIG. 7 is an elevational view, partly in cross section, which depicts how to construct a floor using the assembly type floor panel of FIG. 6.
Figure 8:
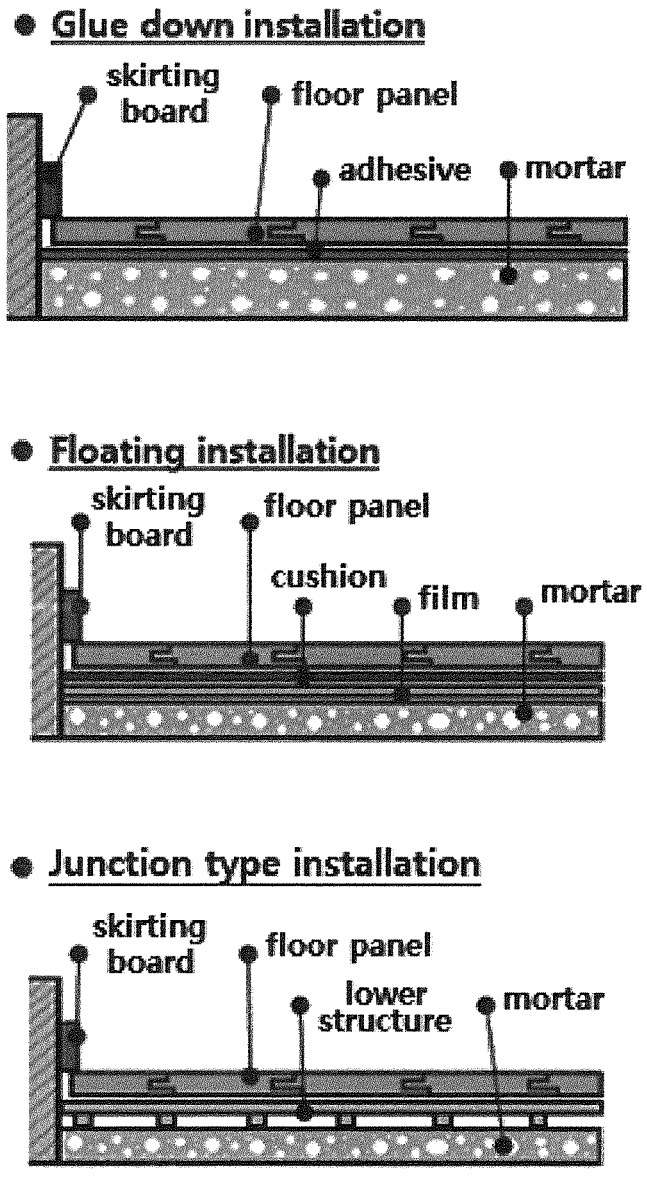
FIG. 8 is a cross-sectional view which depicts conventional adhesive type, suspension type and junction type floors.

FIGS. 6 and 7 depict another embodiment of the invention. In this embodiment, a tubular rod 50 containing an adhesive 51 is provided as an outermost portion of the projecting part 11, and a metal colliding member 60 is provided on the upper side of the tubular rod 50. The tubular rod is made of a highly brittle synthetic resin and extends along the outermost portion of the projecting part 11. The adhesive 51 stored inside the tubular rod 50 flows outward when the synthesized resin is destroyed by impact imparted to the rod by the colliding member 60. The colliding member 60 is in the shape of an elongated bar, extends along the upper side of the tubular rod 50, is attached and fixed on the upper side of the tubular rod 50, and has a concave lower surface 61 matching the upper side of the tubular rod 50.

When the joint of the assembly type floor panel is struck downward by a hammer after inserting the projecting part 11 into the binding groove 12 on an adjacent panel as depicted by an arrow in FIG. 7, the impact causes the colliding member 60 to break the tubular rod 50, releasing the stored adhesive 51, which then flows outward. The projecting part 11 and binding groove 12 are attached and fixed firmly to each other by the adhesive 51, which is smeared through the gap between the projecting part 11 and binding groove 12.

The use of the tubular rod containing a stored adhesive has the advantage of fixing the assembly type floor panels firmly to one another. The embodiment incorporating the tubular rod containing a stored adhesive retains many of the advantages of the previously described embodiments, including the fact that the assembly type floor panel non-adhesively and closely contacts the underlying floor, and construction, dismantling and maintenance can be carried out easily.

Figure 9:
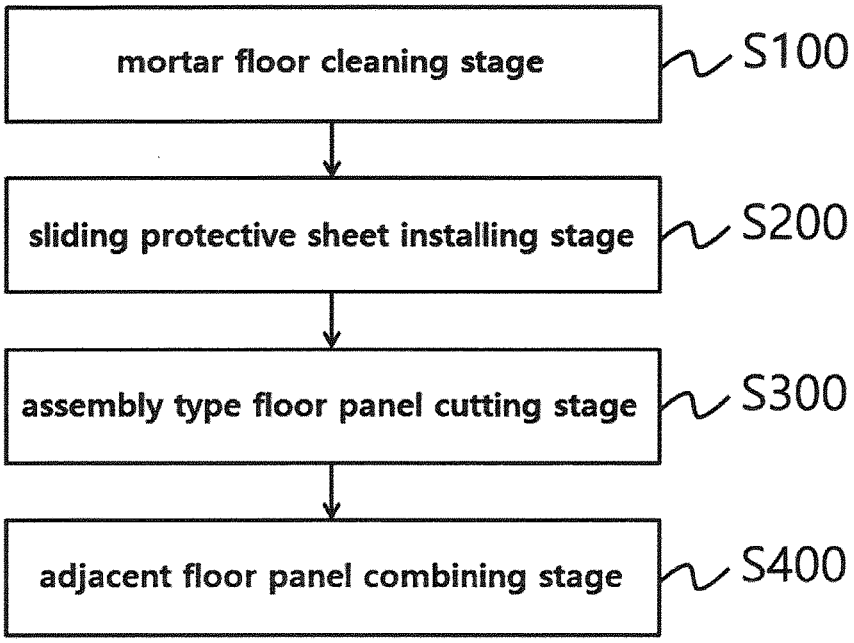
FIG. 9 is a flowchart explaining steps in the construction of an assembly type floor panel in accordance with the invention.
Figure 10:
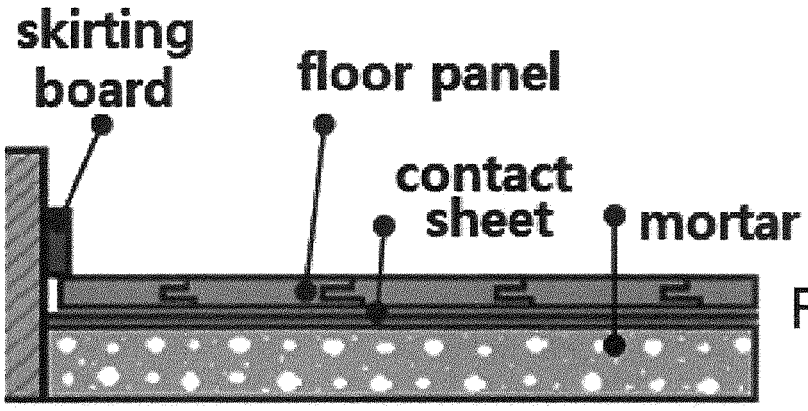
FIG. 10 is a cross-sectional view of a floor constructed by utilizing the steps depicted in FIG. 9.

As depicted in FIGS. 9 and 10, the construction method comprises a mortar floor cleaning stage S100, a sliding protective sheet installing stage S200, an assembly type floor panel cutting stage S300, and an adjacent floor panel combing stage S400.

In the first stage, S100, the horizontal error from external factors is minimized by cleaning dust and foreign matter from the mortar surface on which the assembly type floor panel is to be constructed. In the sliding protective sheet installation stage S200, the sliding protective sheet is brought into contact with the cleaned mortar floor without using adhesive. Next, in the assembly type floor panel cutting stage S300, the edge of the floor panel is cut to the required length, depending on the dimension of the floor, by using a knife or similar cutting instrument without creating dust and noise. Finally, in the adjacent floor panel combining stage S400, adjacent floor panels are brought together and placed on the sliding protective sheet.

It is desirable to verify the performance of the assembly type floor panels insofar as sliding protection and heat conduction are concerned by ensuring that they satisfy performance test standards as in the following demonstrative examples.

Demonstrative Example 1

The amount of sliding is tested by putting the assembly type floor panel on a cement board declined by 60 degrees from horizontal. Table 1 below shows the results of tests performed for an adhesive type floor, a floating type floor and a veneer floor under the same conditions.

TABLE 1

Results of sliding protective test

| | Assembly type floor panel | Adhesive type floor | Floating type floor | Veneer floor |
|---|---|---|---|---|
| Test result | Fixed without sliding | Sliding downwards | Sliding downwards | Sliding downwards |

The excellent sliding protective performance for the assembly type floor panel according to the invention was verified by the above sliding protective test results. When installed, the assembly type floor panel does not move horizontally as it contacts the underlying mortar floor closely and is prevented from sliding by the sliding protective sheet.

Demonstrative Example 2

The initial surface temperature of the specimen is set at 25° C. The specimen is then placed in a constant temperature water bath at 45° C., and the time required for the surface temperature of the specimen to increase by 10° C. from its initial temperature) of 25° C. is determined.

TABLE 2

| Heat conduction rate test result | | | |
|---|---|---|---|
| | Assembly type floor panel | On-dol floor (Adhesive type) | Non-adhesive floor (Suspension type) |
| Specification | 120 × 1200 × 8.0 mm | 75 × 900 × 7.5 mm | 196 × 1200 × 8.0 mm |
| Construction condition | Construct on 6 mm mortar plate | | |
| Test result | 20 minutes 12 seconds | 18 minutes 6 seconds | 40 minutes 12 seconds |

The excellent heat conductivity of the assembly type floor panel according to the invention can be seen from the test results of heat conduction ratio in the above table. It takes only about 2 more minutes for the assembly type floor panel to reach the test temperature when compared to an adhesive ondol floor with highest heat conductivity. The assembly type floor panel is very appropriate in Korea, where there are many ondol heating systems and about twice as many adhesive type ondol floors as suspension type floors.

The invention has been explained by referring to the embodiments depicted in the drawing, but these embodiments are only demonstrative. Persons skilled in the art will understand that various modifications and other equivalent embodiments are available. Accordingly, the true scope of the is intended to be defined by the following claims.

What is claimed is:

1. A flooring construction comprising a plurality of floor panels arranged in side-by-side relationship, wherein:

each of said floor panels comprises a base panel made of elastic material and having an upper and lower face, a layer of surface material on the upper face of the base panel, the surface material being composed of a material lighter than the elastic material of the base panel, a sliding protective sheet on the lower face of the base panel;

each said floor panel has opposite first and second side edges, a projecting part, and a groove extending along the first side edge and a projecting part and a groove extending along the second side edge;

the projecting part extending along the first side edge is located adjacent said upper face, the groove extending along the first side edge is located adjacent the lower face, the projecting part extending along the second side edge is located adjacent said lower face, and the groove extending along the second side edge is located adjacent the upper face;

the projecting part along the first side edge of at least one of said floor panels extends into the groove along the second side edge of an adjacent one of said floor panels and the projecting part along the second side edge of said adjacent one of said floor panels extends into the groove along the first side edge of said at least one of said floor panels; and the projecting part along the first side edge of said at least one of the floor panels is in the shape of a tube extending along said first side edge, said tube being composed of a synthetic resin and containing a liquid adhesive;

and wherein:

said at least one of said floor panels includes a metallic colliding member extending along the first side edge thereof, said colliding member being located above said tube and positioned to engage said tube when struck from above by a hammer, and said tube is sufficiently brittle to be broken by said colliding member when said colliding member is struck from above by a hammer;

whereby, by breaking said tube, the liquid adhesive material contained therein is discharged and secures said at least one panel to said adjacent panel.

2. The flooring construction according to claim 1, in which said base panel is composed of calcium carbonate board.

3. The flooring construction according to claim 1, in which said base panel is composed of PVC board.

4. The flooring construction according to claim 1, in which said sliding protective sheet comprises a layer of non-woven fabric having an upper side and a lower side, said upper side being in contact with a bottom side of the base panel, and said lower side having a silicone coating for contact with an underlying floor.

5. The flooring construction according to claim 1, in which said sliding protective sheet comprises a layer of non-woven fabric having an upper side and a lower side, said upper side being in contact with a bottom side of the base panel, and said lower side having a coating thereon comprising spaced dots of silicone for contact with an underlying floor.

6. A method of constructing flooring comprising the steps of:

placing a sliding protective sheet on an underlying floor;

assembling a plurality of floor panels in side-by-side relationship on said sliding protective sheet, wherein:

each of said floor panels comprises a base panel made of elastic material and having an upper and lower face, a layer of surface material on the upper face of the base panel, the surface material being composed of a material lighter than the elastic material of the base panel;

each said floor panel has opposite first and second side edges, a projecting part, and a groove extending along the first side edge and a projecting part and a groove extending along the second side edge;

the projecting part extending along the first side edge is located adjacent said upper face, the groove extending along the first side edge is located adjacent the lower face, the projecting part extending along the second side edge is located adjacent said lower face, and the groove extending along the second side edge is located adjacent the upper face;

the projecting part along the first side edge of at least one of said floor panels extends into the groove along the second side edge of an adjacent one of said floor panels and the projecting part along the second side edge of said adjacent one of said floor panels extends into the groove along the first side edge of said at least one of said floor panels; and the projecting part along the first side edge of said at least one of the floor panels is in the shape of a tube extending along said first side edge, said tube being composed of a synthetic resin and containing a liquid adhesive;

and wherein:

said at least one of said floor panels includes a metallic colliding member extending along the first side edge thereof, said colliding member being located above said tube and positioned to engage said tube when struck from above by a hammer, and said tube is sufficiently brittle to be broken by said colliding member when said colliding member is struck from above by a hammer; and by breaking said tube, causing the liquid adhesive material contained therein to be discharged and secure said at least one panel to said adjacent panel.

* * * * *